US010323893B2

(12) United States Patent
Ramos

(10) Patent No.: US 10,323,893 B2
(45) Date of Patent: Jun. 18, 2019

(54) ADAPTER FOR COUPLING AMMUNITION MAGAZINES

(71) Applicant: Frank J. Ramos, Sherman Oaks, CA (US)

(72) Inventor: Frank J. Ramos, Sherman Oaks, CA (US)

( * ) Notice: Subject to any disclaimer, the term of this patent is extended or adjusted under 35 U.S.C. 154(b) by 0 days.

(21) Appl. No.: 16/043,123

(22) Filed: Jul. 23, 2018

(65) Prior Publication Data

US 2019/0154372 A1 May 23, 2019

Related U.S. Application Data

(60) Provisional application No. 62/552,283, filed on Nov. 17, 2017.

(51) Int. Cl.
*F41A 9/63* (2006.01)

(52) U.S. Cl.
CPC ..... *F41A 9/63* (2013.01)

(58) Field of Classification Search
CPC ..... F41A 9/63; F41A 9/61
USPC ..... 42/50, 49.01
See application file for complete search history.

(56) References Cited

U.S. PATENT DOCUMENTS

| | | | | |
|---|---|---|---|---|
| 3,191,332 | A * | 6/1965 | Ardolino | F41A 9/63 42/50 |
| 5,666,752 | A | 9/1997 | Grams | |
| 7,073,285 | B2 * | 7/2006 | Obong | F42B 39/02 224/931 |
| 7,117,622 | B2 | 10/2006 | Freed et al. | |
| 8,607,489 | B1 | 12/2013 | Calvert | |
| 9,354,006 | B2 * | 5/2016 | Purkiss | F41A 9/68 |
| 9,631,883 | B2 * | 4/2017 | Grandy | F41A 9/63 |
| 10,126,076 | B2 * | 11/2018 | Klein | F41A 9/63 |
| 2017/0030668 | A1 * | 2/2017 | Klein | F41A 9/63 |

* cited by examiner

*Primary Examiner* — Reginald S Tillman, Jr.
(74) *Attorney, Agent, or Firm* — Loza & Loza, LLP; David S. Sarisky

(57) ABSTRACT

An adapter for coupling ammunition magazines together comprises a structure formed to include a first interior pocket having an opening facing in a first direction, and a second interior pocket having an opening facing in a second direction opposite the first direction. The first interior pocket is configured to receive a base of a first magazine, while the second interior pocket is configured to receive a base of a second magazine. To enable receipt of a magazine base by a pocket and a tight, secure fit within the pocket, the first interior pocket has an interior dimension slightly less than a corresponding exterior dimension of the base of the first magazine, and the second interior pocket has an interior dimension slightly less than a corresponding exterior dimension of the base of the second magazine.

5 Claims, 6 Drawing Sheets

ADAPTER FOR COUPLING AMMUNITION MAGAZINES

TECHNICAL FIELD

The present disclosure relates generally to accessories for ammunition magazines, and more particularly to an adapter for coupling together multiple ammunition magazines.

BACKGROUND

Standard ammunition magazines hold a set number of rounds of ammunition. Once a magazine is emptied, it is removed from the handgun and a different, loaded magazine is located and installed in the handgun. This process of removing and locating magazines takes time and is inconvenient.

It is desirable to provide a more efficient and convenient way to locate and install a loaded magazine. The concepts disclosed below address these needs and others.

SUMMARY

An adapter for coupling ammunition magazines together includes a structure formed to include a first interior pocket having an opening facing in a first direction, and a second interior pocket having an opening facing in a second direction opposite the first direction. The first interior pocket is configured to receive a base of a first magazine, while the second interior pocket is configured to receive a base of a second magazine. To enable receipt of a magazine base by a pocket and a tight, secure fit within the pocket, the first interior pocket may have an interior dimension that is slightly less than a corresponding exterior dimension of the base of the first magazine. Likewise, the second interior pocket may have an interior dimension that is slightly less than a corresponding exterior dimension of the base of the second magazine. The slight difference in dimension between the interior of the pocket and the exterior of the base allows for the magazine to be slid into the pocket using some force, and to be secured therein by a tight, snug fit between the pocket and the base.

In one aspect of the adapter, the first interior pocket is defined by a first pair of opposed sidewalls, a first end wall, and a first floor, and the second interior pocket is defined by a second pair of opposed sidewalls, a second end wall, and a second floor. The first floor and the second floor may be opposite surfaces of a same structure. To enable receipt of a magazine base by a pocket and a tight, secure fit within the pocket, a distance between the first pair of opposed sidewalls defines an interior width that is slightly less than an exterior width of the base of the first magazine, and a distance between the second pair of opposed sidewalls defines an interior width that is slightly less than an exterior width of the base of the second magazine. Accordingly, a magazine base may snugly fit into an opening between the opposed sidewalls and be pushed into and out of the pocket.

In another aspect of the adapter, the first interior pocket is further defined by a plurality of first lips and the second interior pocket is further defined by a plurality of second lips. Each first lip extends inward, toward the center of the first interior pocket, from the top of one or more of the first pair of opposed sidewalls, while each second lip extends inward, toward the center of the second interior pocket, from the top of one or more of the second pair of opposed sidewalls. To enable receipt of a magazine base by a pocket and a tight, secure fit within the pocket, a distance between the first floor and each first lip defines an interior height that may be slightly less than an exterior height of the base of the first magazine, and a distance between the second floor and each second lip defines an interior height that may be slightly less than an exterior height of the base of the second magazine. Accordingly, a magazine base may snugly fit into the space between the opposed lips and floor and be slid into and out of the pocket. Furthermore, each of the first lips is configured to extend over a portion of the base of the first magazine, and each of the second lips is configured to extend over a portion of the base of the second magazine to secure the magazines in place in each of the respective interior pockets.

In another aspect, the first interior pocket of the adapter has an interior contour having a radius of curvature corresponding to an exterior radius of curvature of the base of the first magazine. Likewise, the second interior pocket has an interior contour having a radius of curvature corresponding to an exterior radius of curvature of the base of the second magazine. The interior contours function to mate with the contours of the magazine bases to ensure that the magazines are inserted into the pockets in the proper direction.

It is understood that other aspects of adapters will become readily apparent to those skilled in the art from the following detailed description, wherein various aspects of apparatuses and methods are shown and described by way of illustration. As will be realized, these aspects may be implemented in other and different forms and its several details are capable of modification in various other respects. Accordingly, the drawings and detailed description are to be regarded as illustrative in nature and not as restrictive.

BRIEF DESCRIPTION OF THE DRAWINGS

Various aspects of adapters for ammunition magazines will now be presented in the detailed description by way of example, and not by way of limitation, with reference to the accompanying drawings, wherein.

DETAILED DESCRIPTION

Figure 1A:
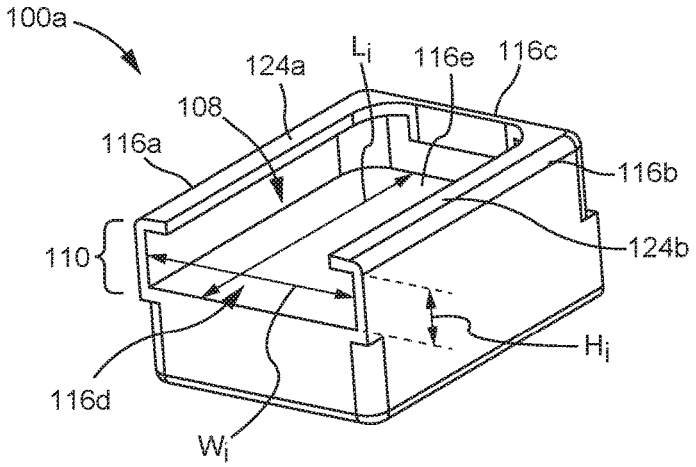
FIGS. 1A-1C are illustrations of different views of a first embodiment of an adapter for coupling together multiple ammunition magazines.
Figure 1B:
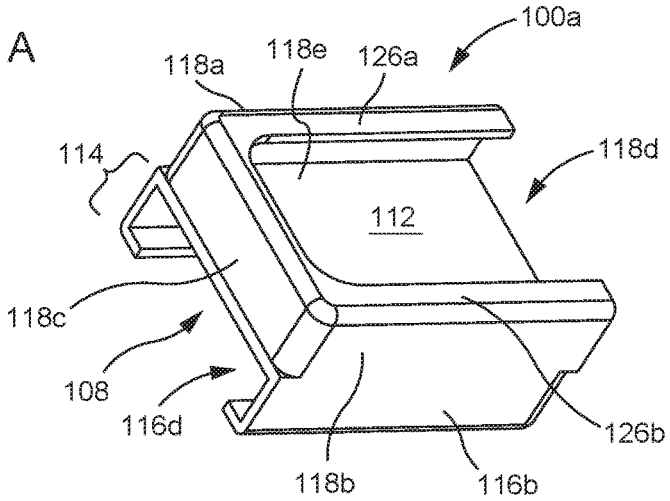
Figure 1C:
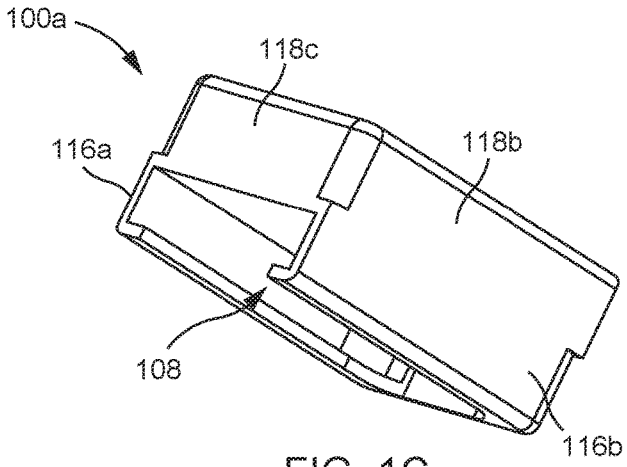

With reference to FIGS. 1A-1C and 2A-2C, disclosed herein is an adapter 100*a*, 100*b* configured to couple together two ammunition magazines. The adapter 100*a*, 100*b* includes a first interior pocket 108 on a first side 110 of the adapter and an opposite facing, second interior pocket 112 on a second side 114 of the adapter that is opposite the first side. Each of the interior pockets 108, 112 is sized to snugly receive and secure in place a respective ammunition magazine.

In the embodiments shown in FIGS. 1A-1C and 2A-2C, the first interior pocket 108 is defined by a floor 116*e*, two opposed sidewalls 116*a*, 116*b*, an end wall 116*c*, and an opening 116*d* through which a base of a first ammunition magazine may be slideably inserted. The second interior pocket 112 is also defined by a floor 118*e*, two opposed sidewalls 118*a*, 118*b*, and end wall 118*c*, and an opening 118*d* through which a base of a second ammunition magazine may be slideably inserted. The floors 116*e*, 118*e* may correspond to opposite surfaces of a same plate structure spanning between the sidewalls.

The openings 116*d*, 118*d* of the respective interior pockets 108, 112 are located on opposite ends of the adapter 100*a*, 100*b* so as to be opposite facing. The interior pockets 108, 112 are sized and contoured to slideably receive and secure in place a magazine base. To this end, the interior pockets 108, 112 of the adapters have interior dimensions (length, width, and height) that allow the sidewalls of the adapter 100*a*, 100*b* to fit around the sides and front of a magazine base.

One or more of these interior dimensions may be substantially equal to or slightly less, e.g., on the order of one or more microns less, than a corresponding exterior dimension of the magazine base. One or more of these interior dimensions may be slightly greater than e.g., on the order of one or more microns greater, than a corresponding exterior dimension of the magazine base. Ultimately, the differences between the dimensions of the interior pockets 108, 112 and the exterior dimensions of the magazine base are configured to allows for the magazine base to be slid by forced into a pocket, secured in place in the pocket, and subsequently slid by force from the pocket.

In one configuration, the interior dimensions of the pockets 108, 112 may be slightly less than the cross-section dimensions of the magazine base. For example, the interior width $W_i$ of the pockets 108, 112 may be slightly less than the exterior width $W_e$ of the magazine base. As such, the opposed sidewalls 116*a*, 116*b*, 118*a*, 118*b* defining the interior pockets 108, 112 of the adapter fit tightly against the sides of the magazine base so that the adapter secures the magazine in place through compression and a friction fit. To aid in receipt of a magazine base, the thickness of the opposed sidewalls 116*a*, 116*b*, 118*a*, 118*b* and the material from which the adapter is formed, may allow for some flexing or displacement of the sidewalls as the magazine base is slid by force into the pocket.

With continued reference to FIGS. 1A-1C and 2A-2C, the top of one or more of the sidewalls 116*a*, 116*b*, 118*a*, 118*b* may include a lip 124*a*, 124*b*, 126*a*, 126*b* the extends inward toward the center of the interior pocket 108, 112. When a base of a magazine 104, 106 is placed inside the pocket 108, 112, the lips 124*a*, 124*b*, 126*a*, 126*b* rest above the base of the magazine and function to further secure the magazine in place within the pocket.

The distance between the underside of each lip 124*a*, 124*b*, 126*a*, 126*b* and the respective floor 116*e*, 118*e* of the interior pocket 108, 112 defines the interior height $H_i$ of the pocket. Like the interior width $W_i$, the interior height $H_i$ of the pockets 108, 112 may be slightly less than the exterior height $H_e$ of the magazine base. As such, the magazine base fits tightly between the lips 124*a*, 124*b*, 126*a*, 126*b* and floor 116*e*, 118*e* of the pockets 108, 112 so that the adapter further secures the magazine in place through compression and a friction fit. To aid in receipt of a magazine base, the thickness of the opposed lips 124*a*, 124*b*, 126*a*, 126*b* and the material from which the adapter is formed, may allow for some flexing or displacement of the lips as the magazine base is slid by force into the pocket.

Figure 3:
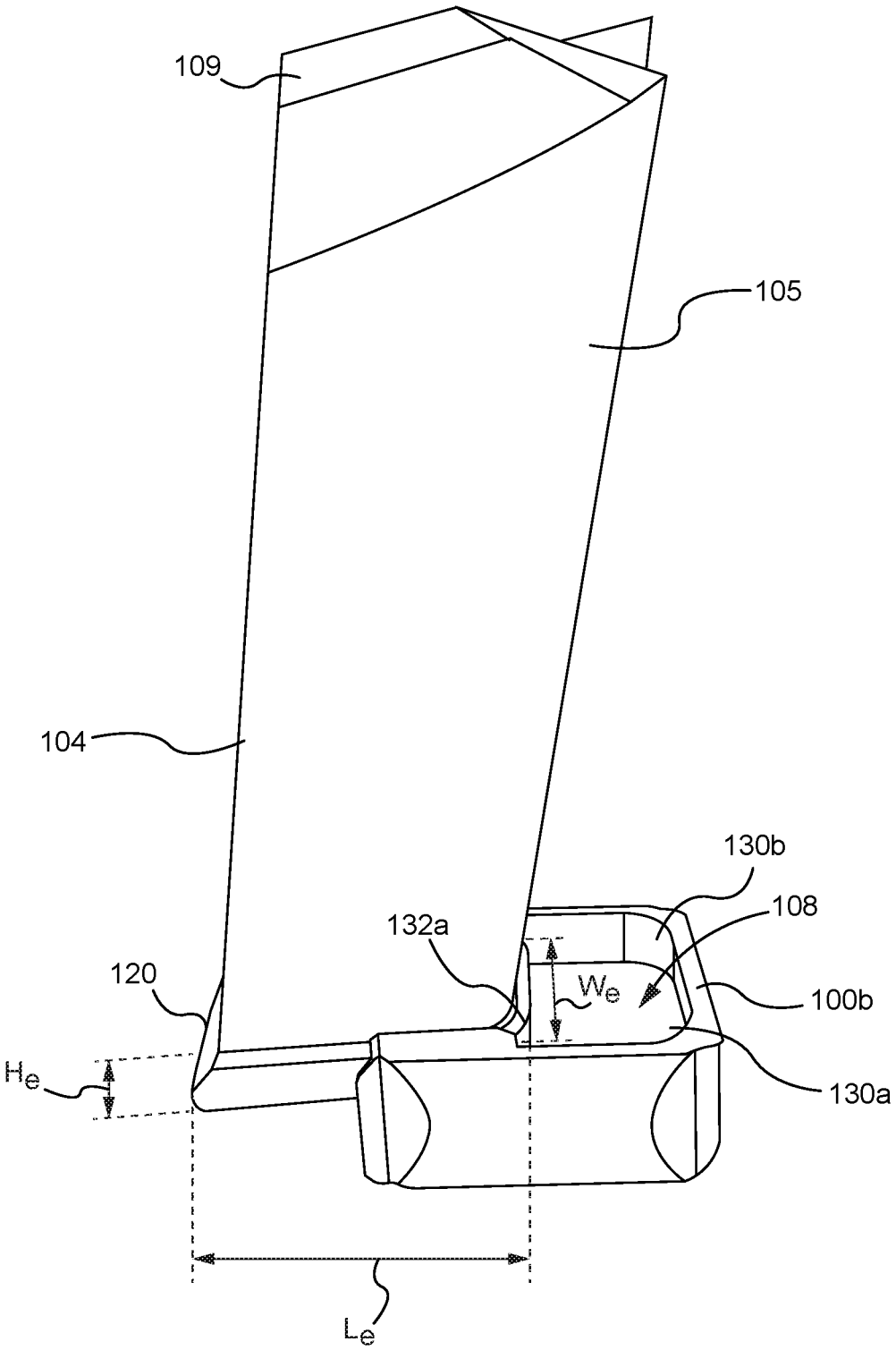
FIG. 3 is an illustration of a first magazine partially inserted into a side of an adapter for coupling together multiple ammunition magazines.
Figure 4:
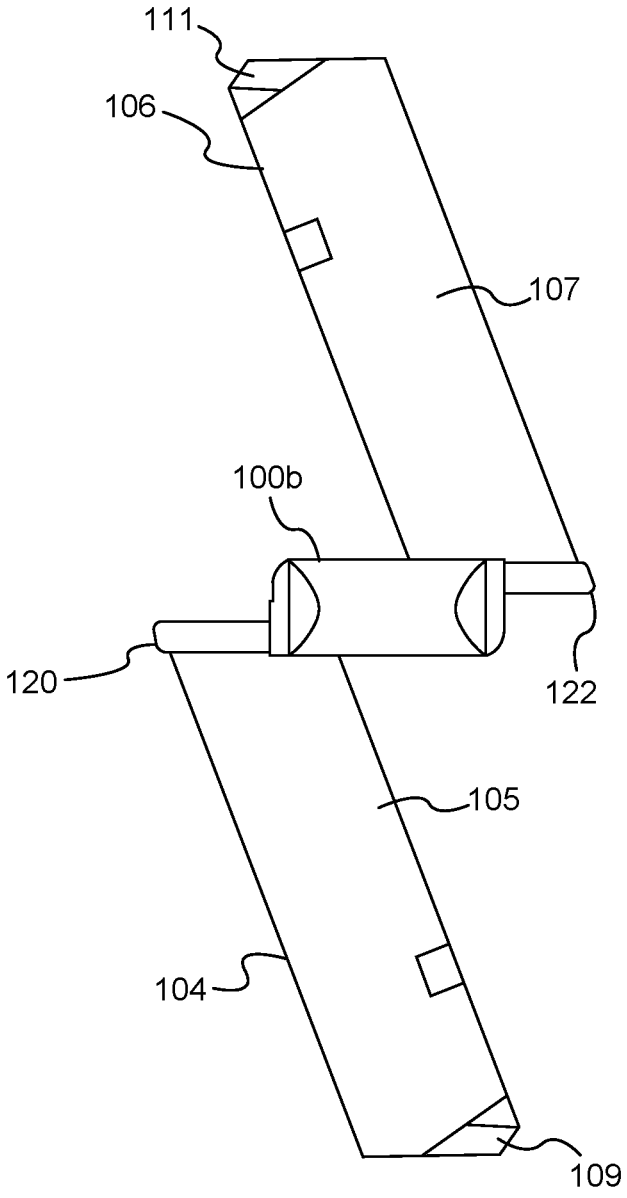
FIG. 4 is an illustration of a first magazine and a second magazine, each partially inserted into opposite sides of an adapter for coupling together multiple ammunition magazines.
Figure 5:
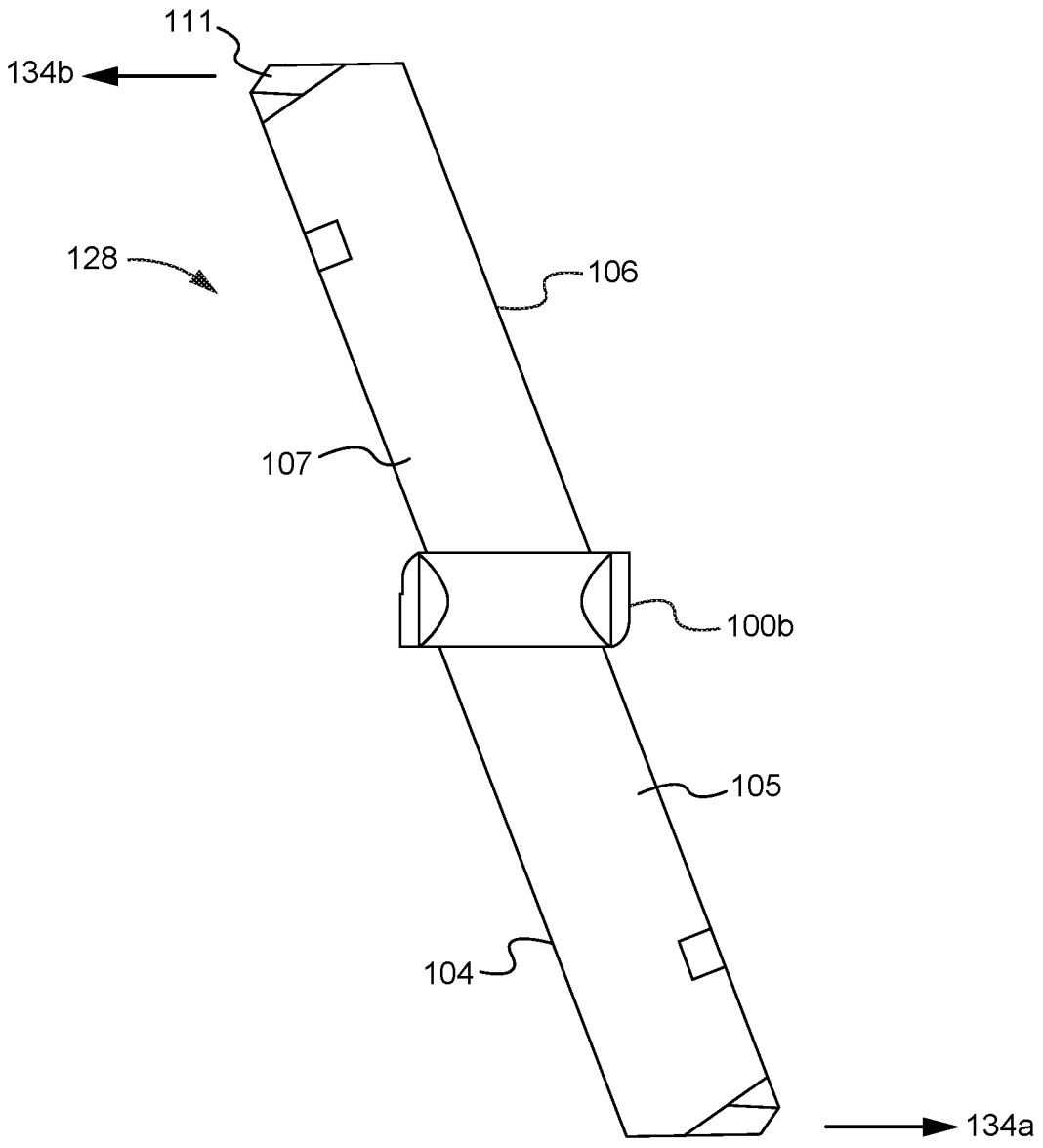
FIG. 5 is an illustration of a first magazine and a second magazine, each completely inserted into opposite sides of an adapter to form a coupled magazine.

With reference to FIGS. 3-5, an ammunition magazine 104, 106 includes an ammunition holding portion 105, 107 having an opening 109, 111 at one end through which ammunition may be loaded and subsequently discharged, and a base 120, 122 at the opposite end. As best shown in FIG. 3, the perimeter of the base 120 extends outward from the ammunition holding portion 105 and is characterized by an exterior length $L_e$, width $W_e$ and height $H_e$.

With reference to FIGS. 4 and 5, the base 120 of a first magazine 104 may be placed in the first interior pocket 108 of the adapter 100*b* by sliding the base through the opening 116*d* of the pocket until the base is fully seated in the pocket (as shown in FIG. 5). Likewise, the base 122 of a second magazine 106 may be placed in the opposite-facing second interior pocket 112 by sliding the base through the opening 118*d* until the base is fully seated in the pocket (as shown in FIG. 5). Upon complete insertion of the first and second magazines 104, 106, a coupled magazine 128 (as shown in FIG. 5) with twice the number of rounds as a single magazine is provided.

Figure 2A:
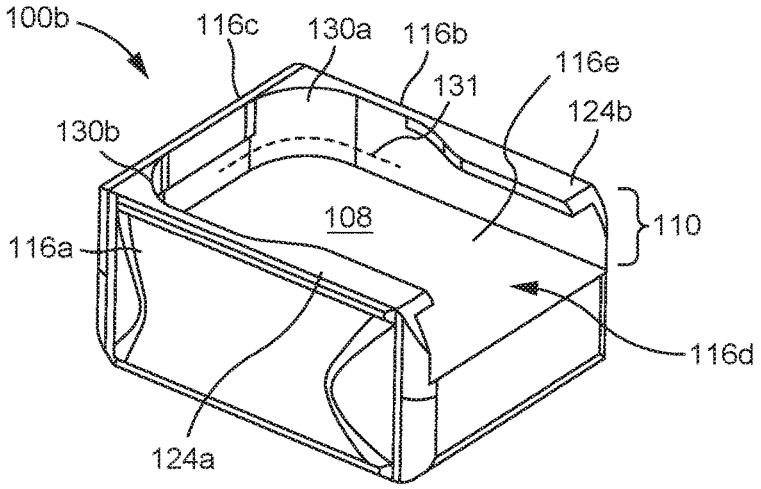
FIGS. 2A-2C are illustrations of different views of a second embodiment of an adapter for coupling together multiple ammunition magazines.
Figure 2B:
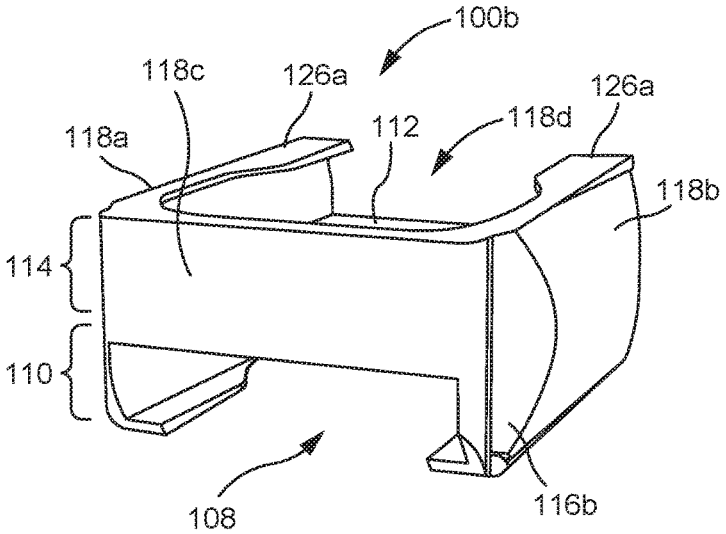
Figure 2C:
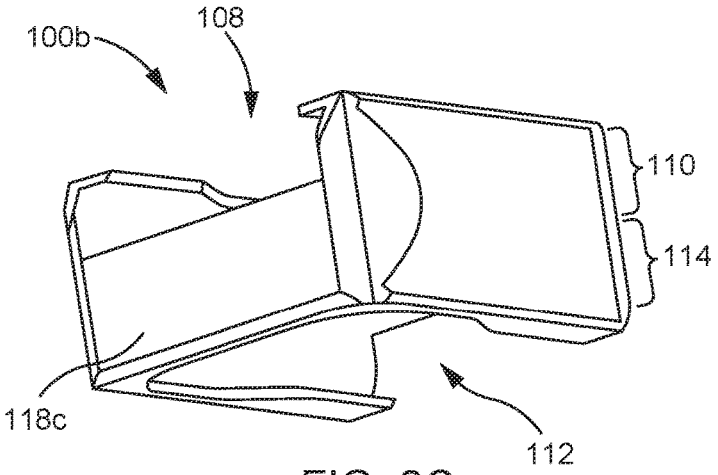

With reference to FIGS. 2A-2C, as previously mentioned, the interior pockets 108, 112 may be contoured to ensure that ammunition magazines are inserted into the adapter 100*b* in the proper facing direction. To this end, the interior pockets 108, 112 may include a curved interior perimeter 131 that matches the curved outer perimeter of a magazine base. For example, with reference to FIGS. 2A, 3 and 5, the interior pocket 108 includes curved corners 130*a*, 130*b*, each having a radius of curvature that corresponds to a radius of curvature 132*a* of the magazine base. In one configuration, only one end of the magazine base is formed with curves. Accordingly, forming the interior pockets with a corresponding contour helps ensure that each respective magazine 104, 106 can only be fully inserted into the adapter 100*b* in an orientation such that the ammunition exit directions 134*a*, 134*b* of the resulting coupled magazine 128 are facing in opposite directions (as shown in FIG. 5).

Figure 7:
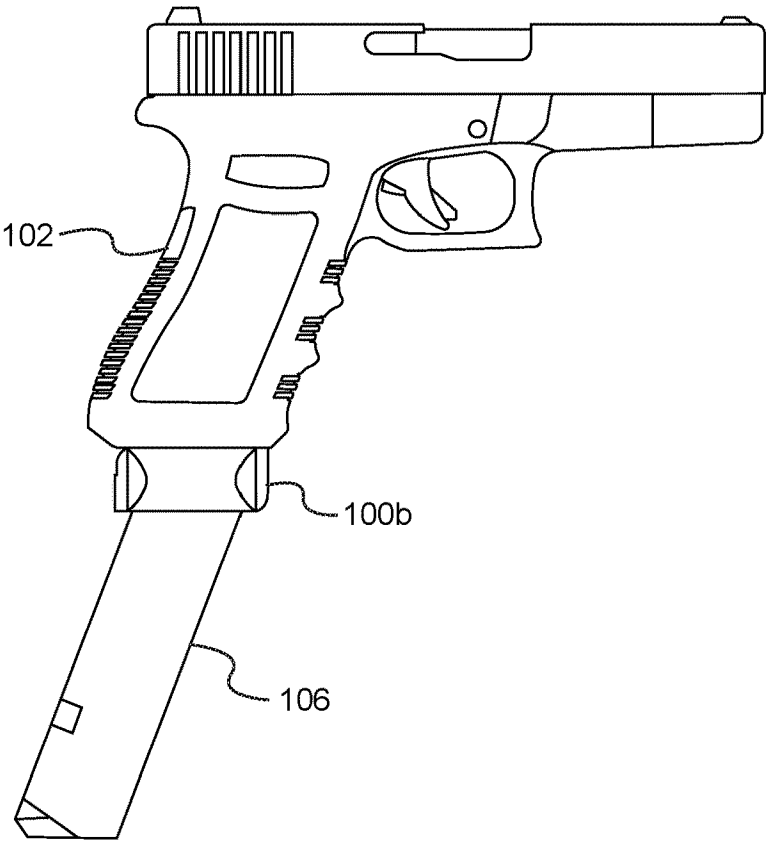
FIG. 7 is an illustration of the coupled magazine of FIG. 5 completely installed in a handle of a handgun.
Figure 6:
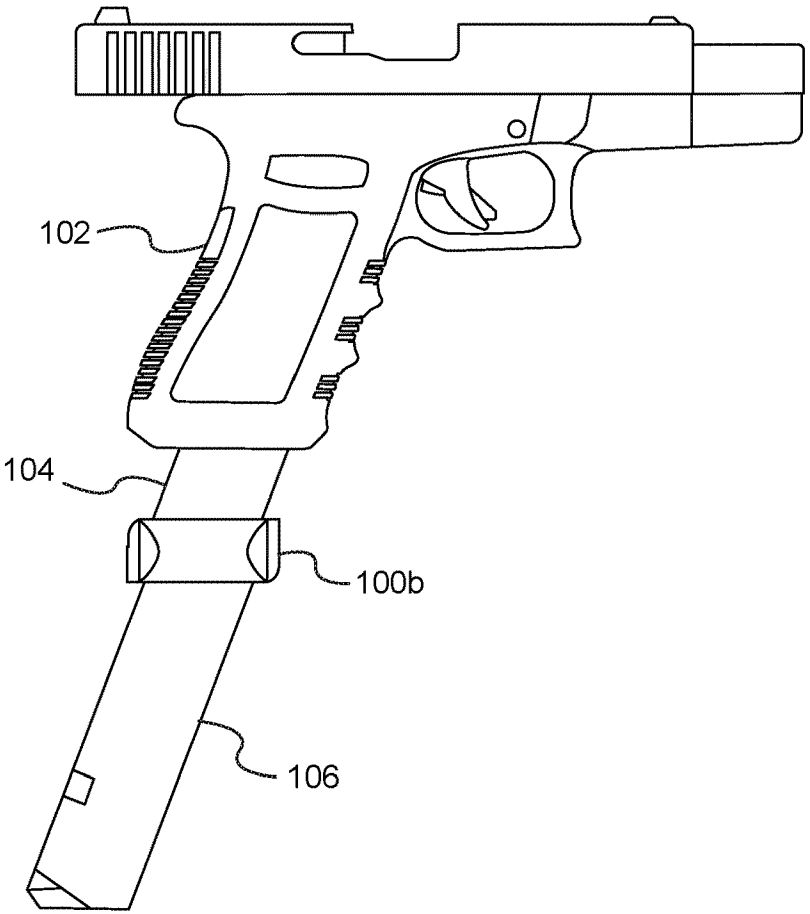
FIG. 6 is an illustration of the coupled magazine of FIG. 5 partially installed in a handle of a handgun.

With reference to FIGS. 6 and 7, in use, the first magazine 104 of the coupled magazine 128 of FIG. 5 is inserted into the handle of the handgun 102 and rounds are fired until the first magazine is emptied. The coupled magazine 128 is then withdrawn from the handgun 102 and flipped to allow for inserting of the second magazine 106 into the handgun. Rounds are then fired from the second magazine 106 until the second magazine is emptied.

The adapter 100*a*, 100*b* may be formed of a plastic material using known manufacturing techniques, such as injection molding or 3D printing. The adapter 100*a*, 100*b* may be formed as a single contiguous piece. Alternatively, multiple components pieces may be separately manufactures and then fixedly coupled, e.g., bonded, to each other to form an adapter 100*a*, 100*b*.

Different configurations of the adapter may be formed, each having interior pockets sized accordingly to receive magazines of different sizes. Thus, the adapter 100*a*, 100*b* of the present invention may be formed to fit a variety of magazine handgun models desirous of using extended width magazines without any modifications to the magazine itself.

Thus, disclosed herein is an adapter 100*a*, 100*b* for coupling ammunition magazines 104, 106 together that comprises a structure formed to include a first interior pocket 108 having an opening 116*d* facing in a first direction, and a second interior pocket 112 having an opening

118*d* facing in a second direction opposite the first direction. The first interior pocket 108 is configured to receive a base 120 of a first magazine 104, while the second interior pocket 112 is configured to receive a base of a second magazine 106. To enable receipt of a magazine base 120 by a pocket and a tight, secure fit within the pocket, the first interior pocket 108 has an interior dimension slightly less than a corresponding exterior dimension of the base 120 of the first magazine 104, and the second interior pocket 112 has an interior dimension slightly less than a corresponding exterior dimension of the base of the second magazine 106. The difference between the interior dimension of the pocket and the exterior dimension of the base may be on the order of one or several microns. This difference is selected to allow for the magazine base to be slid by force into and secured inside the pocket, and subsequently slid by force out of the pocket.

In one aspect of the adapter 100*a*, 100*b*, the first interior pocket 108 is defined by a first pair of opposed sidewalls 116*a*, 116*b*, a first end wall 116*c*, and a first floor 116*e*, and the second interior pocket 112 is defined by a second pair of opposed sidewalls 118*a*, 118*b*, a second end wall 118*c*, and a second floor 118*e*. The first floor 116*e* and the second floor 118*e* may be opposite surfaces of a same structure, e.g., a plate spanning between the sidewalls. To enable receipt of a magazine base 120 by a pocket and a tight, secure fit within the pocket, a distance between the first pair of opposed sidewalls 116*a*, 116*b* defines an interior width that is slightly less than an exterior width of the base 120 of the first magazine 104, and a distance between the second pair of opposed sidewalls 118*a*, 118*b* defines an interior width that is slightly less than an exterior width of the base of the second magazine 106. Accordingly, a magazine base 120 may snugly fit between the opposed sidewalls 116*a*, 116*b* and 118*a*, 118*b* and slide into the pocket.

In another aspect of the adapter 100*a*, 100*b*, the first interior pocket 108 is further defined by a plurality of first lips 124*a*, 124*b* and the second interior pocket 112 is further defined by a plurality of second lips 126*a*, 126*b*. Each first lip 124*a*, 124*b* extends inward, toward the center of the first interior pocket 108, from the top of one or more of the first pair of opposed sidewalls 116*a*, 116*b*, while each second lip 126*a*, 126*b* extends inward, toward the center of the second interior pocket 112, from the top of one or more of the second pair of opposed sidewalls 118*a*, 118*b*. To enable receipt of a magazine base 120 by a pocket and a tight, secure fit within the pocket, a distance between the first floor 116*e* and each first lip 124*a*, 124*b* defines an interior height that is slightly less than an exterior height of the base of the first magazine 104, and a distance between the second floor 118*e* and each second lip 126*a*, 126*b* defines an interior height that is slightly less than an exterior height of the base of the second magazine 106. Accordingly, a magazine base 120 may snugly fit between the opposed lips and floor and slide into the pocket. Furthermore, each of the first lips 124*a*, 124*b* is configured to extend over a portion of the base 120 of the first magazine 104, and each of the second lips 126*a*, 126*b* is configured to extend over a portion of the base of the second magazine 106 to secure the magazines in place in each of the respective interior pockets.

In another aspect, the first interior pocket 108 of the adapter has an interior contour or curved corners 130*a*, 130*b* having a radius of curvature corresponding to an exterior radius of curvature of the base 120 of the first magazine 104. Likewise, the second interior pocket 112 has an interior contour having a radius of curvature corresponding to an exterior radius of curvature of the base of the second magazine 106. The interior contours function to mate with the contours of the magazine bases 120 to ensure that the magazines are inserted into the pockets in the proper direction.

The various aspects of this disclosure are provided to enable one of ordinary skill in the art to practice the present invention. Various modifications to exemplary embodiments presented throughout this disclosure will be readily apparent to those skilled in the art, and the concepts disclosed herein may be extended to other magnetic storage devices. Thus, the claims are not intended to be limited to the various aspects of this disclosure, but are to be accorded the full scope consistent with the language of the claims. All structural and functional equivalents to the various components of the exemplary embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. An adapter for coupling ammunition magazines together, comprising a structure formed as a single contiguous piece that includes:

a first interior pocket having a first opening facing in a first direction, the first interior pocket defined by a first pair of opposed sidewalls, an first end wall, and a first floor, wherein the first floor corresponds to a first surface of a continuous plate spanning the first sidewalls, and the first interior pocket is configured to receive a base of a first magazine; and a second interior pocket having a second opening facing in a second direction opposite the first direction, the second interior pocket defined by a second pair of opposed sidewalls, a second end wall, and a second floor, wherein the second floor corresponds to a second surface of the continuous plate that is opposite the first surface, and the second interior pocket is configured to receive a base of a second magazine, wherein:

the first interior pocket is further defined by a single pair of first lips, each first lip extending inward, toward a center of the first interior pocket, from a top of one of the first pair of opposed sidewalls, and extending along the sidewall from the first opening and terminating at a point along the sidewall that is remoted from the first end wall, the second interior pocket is further defined by a single pair of second lips, each second lip extending inward, toward a center of the second interior pocket, from a top of one of the second pair of opposed sidewalls, and extending along the sidewall from the second opening and terminating at a point along the sidewall that is remoted from the second end wall, the first interior pocket has an interior contour having a radius of curvature corresponding to an exterior radius of curvature of the base of the first magazine, and the second interior pocket has an interior contour having a radius of curvature corresponding to an exterior radius of curvature of the base of the second magazine.

2. The adapter of claim 1, wherein:

the first interior pocket has an interior dimension less than a corresponding exterior dimension of the base of the first magazine, and the second interior pocket has an interior dimension less than a corresponding exterior dimension of the base of the second magazine.

3. The adapter of claim 1, wherein:

a distance between the first pair of opposed sidewalls defines an interior width that is less than an exterior width of the base of the first magazine, and a distance between the second pair of opposed sidewalls defines an interior width that is less than an exterior width of the base of the second magazine.

4. The adapter of claim 1 wherein:

a distance between the first floor and each first lip defines an interior height that is less than an exterior height of the base of the first magazine, and a distance between the second floor and each second lip defines an interior height that is less than an exterior height of the base of the second magazine.

5. The adapter of claim 1, wherein:

each of the first lips is configured to extend over a portion of the base of the first magazine, and each of the second lips is configured to extend over a portion of the base of the second magazine.

* * * * *